United States Patent [19]

Bessho et al.

[11] Patent Number: 4,857,874

[45] Date of Patent: Aug. 15, 1989

[54] MULTILAYERED-EDDY-CURRENT-TYPE STRONG MAGNETIC FIELD GENERATOR

[75] Inventors: Kazuo Bessho; Sotoshi Yamada, both of Kanazawa, Japan

[73] Assignee: Kanazawa University, Kanazawa, Japan

[21] Appl. No.: 160,294

[22] Filed: Feb. 25, 1988

[30] Foreign Application Priority Data

Jul. 30, 1987 [JP] Japan ..... 62-188921

[51] Int. Cl.[4] ..... H01F 3/00

[52] U.S. Cl. ..... 335/296; 335/299

[58] Field of Search ..... 335/209, 210, 296, 297, 335/299

[56] References Cited

U.S. PATENT DOCUMENTS

| | | | |
|---|---|---|---|
| 2,943,265 | 6/1960 | Kaiser | 335/210 X |
| 3,175,131 | 3/1965 | Burleigh et al. | 335/210 |
| 3,231,842 | 1/1966 | Brower et al. | 335/299 X |

FOREIGN PATENT DOCUMENTS

| | | |
|---|---|---|
| 1329084 | 4/1963 | France . |
| 6384103 | 3/1986 | Japan . |
| 1586796 | 3/1981 | United Kingdom . |

*Primary Examiner*—George Harris
*Attorney, Agent, or Firm*—Spencer & Frank

[57] ABSTRACT

The disclosed strong magnetic field generator has a number of concentric conductor circular plates, central portions thereof being unified, each of which plates has a radial slit so as to have open sidewalls. Exciting coils are mounted between each of the concentric circular plates respectively, so as to induce an eddy current in each of the conductor circular plates in a peripheral direction. A conductor circular plate forming the unified central portions of the concentric circular plates has a central hole and a radial slit extending from the central hole to each of the slits of the concentric circular plates and connected with each other at a periphery thereof, while the central hole is placed at the center of all of the concentric circular plates and while all of the radial slits are aligned in a longitudinal direction. Thus, the path of eddy current in each circular plate is closed through sidewall portions of the radial slit and the central hole, and hence the eddy currents of all the concentric circular plates are superposed at the sidewall portion of the central hole for generating an extremely strong magnetic field in the central hole.

1 Claim, 5 Drawing Sheets

MULTILAYERED-EDDY-CURRENT-TYPE STRONG MAGNETIC FIELD GENERATOR

BACKGROUND OF THE INVENTION

1. Field of the Invention

The present invention relates to a multilayered-eddy-current type strong magnetic field generator which is suitable for various research works in magnetics engineering such as studies of magnetic properties of materials, in power magnetics, in bio-magnetics, and in nuclear fusion. More particularly, the invention relates to a strong magnetic field generator which can continuously generates an extremely strong magnetic field by superposing multiphase eddy currents which are individually induced in multiple conductor layers respectively.

2. Related Art Statement

Much efforts are currently undertaken for research and development of strong magnetic field generators by using large-scale experimental facilities, in order to promote investigations and studies of properties of materials in strong magnetic field, preparation and testing of new materials and experiments on nuclear fusion.

Conventional strong magnetic field generators can be classified into several groups; namely, destructive pulse strong magnetic field generators such as those of KNER method and the implosion method, non-destructive pulse strong magnetic field generators such as those of the multilayered coil type and the so-called MIT type, and continuous strong magnetic field generators such as those of superconductive type and hybrid type.

The strong magnetic field generators of the prior art provided very strong magnetic fields. However, these generators have shortcomings in that the duration of the strong magnetic fields generated is very short, that special facilities such as extremely low temperature apparatus and large power source apparatus are required, that only pulse or direct-current (DC) magnetic field can be generated and that continuous generation of strong alternating-current (AC) magnetic field is not possible.

In order to overcome the above shortcomings of the prior art and to facilitate continuous generation of strong AC magnetic field, the inventors proposed an eddy current type strong AC magnetic field generator in their Japanese Patent Application No. 61(1986)-228,459. More specifically, the eddy current type AC magnetic field generator which was previously proposed by the inventors uses a conductor plate placed in an AC magnetic field to be produced by an electromagnet formed of a coil, so that an eddy current is induced in the conductor plate for generating a counter magnetic field for neutralizing the AC magnetic field of the electromagnet. A cavity is bored in the conductor plate in such a manner that the AC magnetic field due to the eddy current is converged in the cavity so as to intensify the magnetic flux density to an extremely high level at the cavity. Thereby, a very strong AC magnetic field is generated at the cavity by converging the eddy current thereat.

However, the above proposed eddy-current type strong AC magnetic field generator is constructed such as a pair of coils are disposed respectively on both sides of two conductor plates forming a narrow slit therebetween or a single conductor circular plate having a narrow radial slit extending from a periphery to a central hole thereof. Thus, the above eddy-current type strong AC magnetic field generator has a defect that the leakage of magnetic flux to be converged is fairly large, so that it has been difficult to intensify the density of AC magnetic flux in the slit or the central hole to a theoretically expected level.

Subsequently, the inventors disclosed a multilayered-eddy-current type strong magnetic field generator based on the improvement of the above proposed generator in Japanese Patent Application No. 62(1987)-62,708 specification. The above disclosed strong magnetic field generator, which is provided for efficiently increasing the density of AC magnetic flux on the basis of the magnetic flux leakage reduction effected by converging the eddy current generated in the conductor body surrounded by the exciting coil around the central hole of the conductor body, is arranged as shown in FIG. 5. In this arrangement, respectively multilayered conductor cylinders $\mathbf{5}_{1a}$ to $\mathbf{5}_{3a}$ and $\mathbf{5}_{1b}$ to $\mathbf{5}_{3b}$ and exciting coils 10*a* to 12*a* and 10*b* to 12*b*, which are symmetrically disposed in concentric state on upper and lower sides of a circular conductor plate 4, are alternately combined with each other and eddy currents generated in each of the concentric conductor cylinders are converged around a hole 3 provided at the center of the circular conductor plate 4 along a slit 2, so as to efficiently converge magnetic fluxes in the central hole 3.

However, in the conventional multilayered-eddy-current type strong magnetic field generator as disclosed in FIG. 5, the exciting coils 10*a,b* to 12*a,b* are concentrically disposed around the central hole 3, so that respective impedances of these exciting coils are different from each other in order and hence respective eddy currents excited around the central hole 3 by respective coils are different from each other in order. As a result, it is a difficulty of the conventional strong magnetic field generator of this type that the balanced excitation effected multiphase AC currents is hardly available.

SUMMARY OF THE INVENTION

An object of the present invention is to solve the above-mentioned difficulty of the prior art by providing a novel multilayered-eddy-current type strong magnetic field generator improved by a skillful arrangement of multilayered exciting coils such as the AC strong magnetic field can be readily continuously obtained in normal conduction state at room temperature under the excitation of AC current of single phase as well as of multiphase. In this regard, a multilayered-eddy-current type strong magnetic field generator according to the present invention is featured by comprising:

a conductor body composed of a cylinder portion, a single circular plate portion connected with an inner wall of the cylinder portion and provided with a hole at a center thereof and a number of torus-shaped plate portions individually connected with an outer wall of the cylinder portion apart from each other in axial direction, a slit extending in radial direction from a periphery to the central hole being provided throughout all of the aforesaid portions; and a number of exciting coils individually disposed between each of the torus-shaped plate portions of the conductor body along the outer wall of the cylinder portion, wherein eddy currents respectively generated in each of the torus-shaped plate portions of the conductor body under the excitation of the exciting coils in single phase or multiple phases are converged around the central hole of the single circular plate portion thereof through the cylinder portion thereof, so as to generate a concentrated strong magnetic field in the central hole.

Consequently, according to the present invention, the convergence of magnetic fluxes with the effect of eddy currents generated under the excitation in single phase or multiple phases can be efficiently performed with the reduced leakage thereof and hence the density of converged magnetic flux can be arbitrarily increased with a high efficiency and, as a result, a strong AC magnetic field or a strong pulsive magnetic field having an arbitrary magnetic field intensity required for measurement of physical properties of materials, for research work to develop new materials, for studies in bio-magnetics and the like.

BRIEF DESCRIPTION OF THE DRAWINGS

For a better understanding of the invention, reference is made to the accompanying drawings, in which.

Throughout different views of the drawings, the following symbols are used.

1 . . . conductor body, 2 . . . slit,
3 . . . cavity (hole), 4 . . . circular conductor plate,
5 . . . conductor cylinder,
6 to 9 . . . torus-shaped conductor plate,
10 to 12 . . . exciting coil,
13 to 16 . . . eddy current,
$5_{1a}$ to $5_{3a}$, $5_{1b}$ to $5_{3b}$ . . . conductor cylinder,
10*a* to 12*a*, 10*b* to 12*b* . . . exciting coil.

DESCRIPTION OF THE PREFERRED EMBODIMENTS

The invention will be described now in further detail by referring to embodiments.

Figure 1:
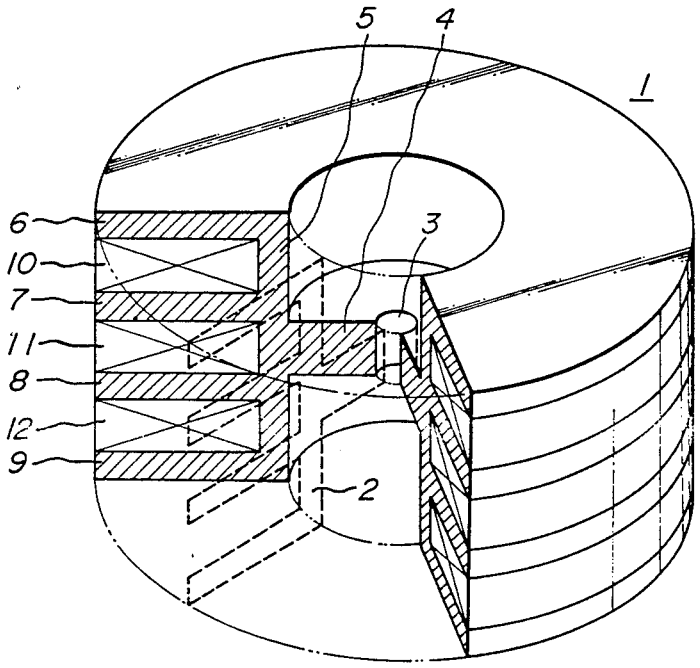
FIG. 1 is a partially cutaway schematic perspective view of the fundamental structure of a multilayered-eddy-current type strong magnetic field generator according to the present invention.
Figure 2:
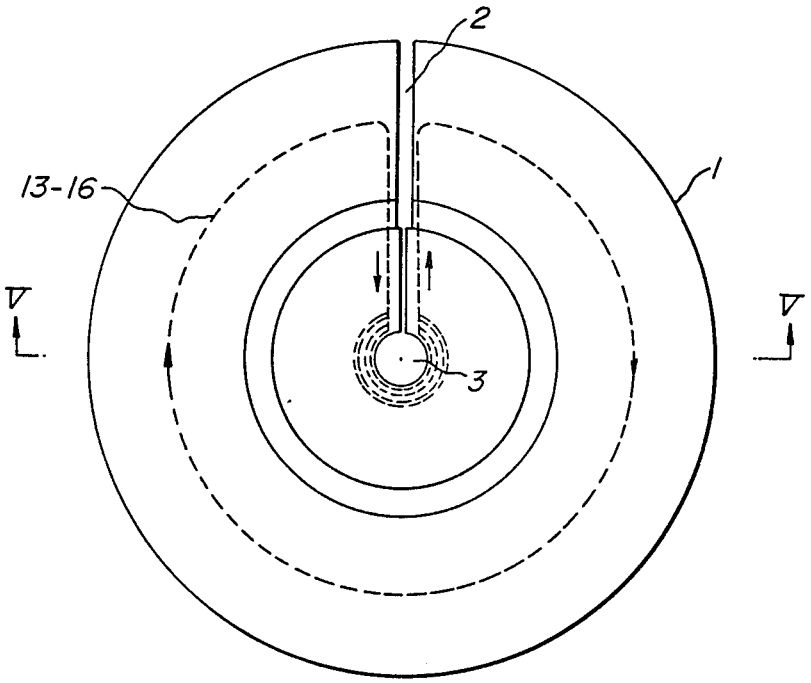
FIG. 2 is a plan view showing the same.
Figure 3:
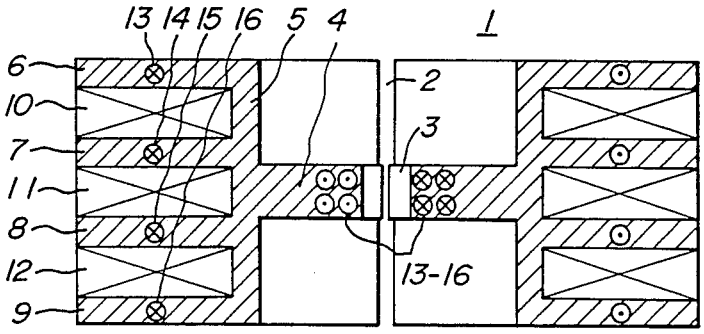
FIG. 3 is a vertical sectional view along the line V—V of FIG. 2 of the same.

First, FIG. 1 shows a partially cutaway perspective view of a fundamental structure of a multilayered-eddy-current type strong magnetic field generator according to the present invention, FIG. 2 shows a plan view of the same and FIG. 3 shows a vertical sectional view of the same along the line V—V of FIG. 2. In this fundamental structure, a peripheral portion of a circular conductor plate 4 consisting, for instance, of a copper plate of 10 mm thickness is divided into plural torus-shaped conductor plates 6 to 9 through a conductor cylinder 5, so as to form a cylindrical conductor body 1 as a whole. In this cylindrical conductor body 1, a hole 3 formed, for instance, in a cylindrical shape is provided at the central portion of the circular conductor plate 4 and further a slit 2 extending from a periphery of the cylindrical conductor body 1 to the central hole 3 in radial direction is provided and still further plural exciting coils, for instance, three exciting coils 10 to 12 as shown in FIGS. 1, 3 are wound individually in each recesses formed between each torus-shaped conductor plates 6 to 9 in contact with an outer wall of the conductor cylinder 5.

In response to the application of AC voltage in single phase or three phases onto the exciting coils 10 to 12 arranged as mentioned above, eddy currents 13 to 16 generated respectively in the torus-shaped conductor plate 6 to 9 being respectively in contact with those exciting coils 10 to 12 flow in the peripheral direction through each of those torus-shaped conductor plates 6 to 9 so as to obstruct the passage of AC magnetic flux. However, these eddy currents 13 to 16 are prevented from the flowing in peipheral direction on the half way by the slit 2 cut away in radial direction and hence the flows of the eddy currents 11 to 14 are entirely turned in radial direction along the slit 2. As a result, all of the eddy current 11 to 14 flow through the conductor cylinder 5 into the circular conductor plate 4, so as to be concentrated around the central hole 3 thereof. Consequently, all of magnetic fluxes induced by the concentrated eddy currents 13 to 16 pass throughout the central hole 3 and hence the magnetic flux density therein is extremely increased, so as to readily generate an extremely strong AC magnetic field therein.

In the arrangement as mentioned above, each of the exciting coils 10 to 12 is combined with the central hole 3 substantially on the same condition and hence the respective impedances of the exciting coils 10 to 12 are substantially the same with each other. As a result, respective operational effects of the eddy currents 13 to 16 generated by the exciting coils 10 to 12 and converged around the central hole 3 are also substantially the same with each other, so that the exciting coils 10 to 12 arranged in the multilayered state as shown in FIGS. 1 and 3 can be efficiently driven by three-phase AC power source.

Figure 4:
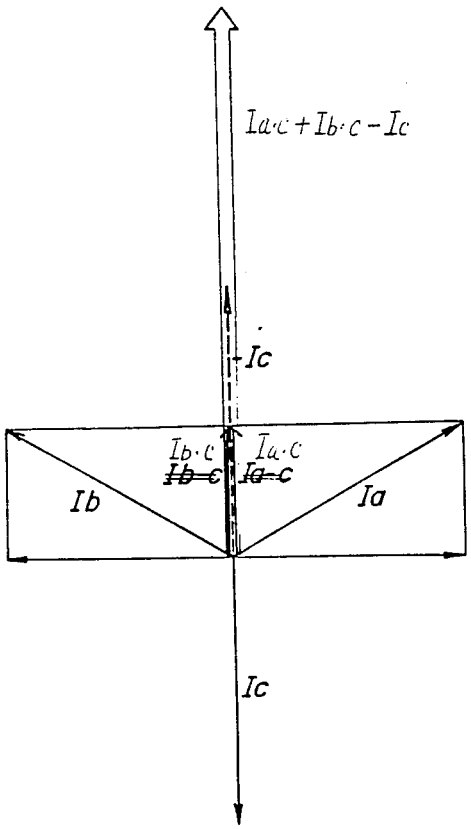
FIG. 4 is a vector diagram showing the operational effect of the same.
Figure 5:
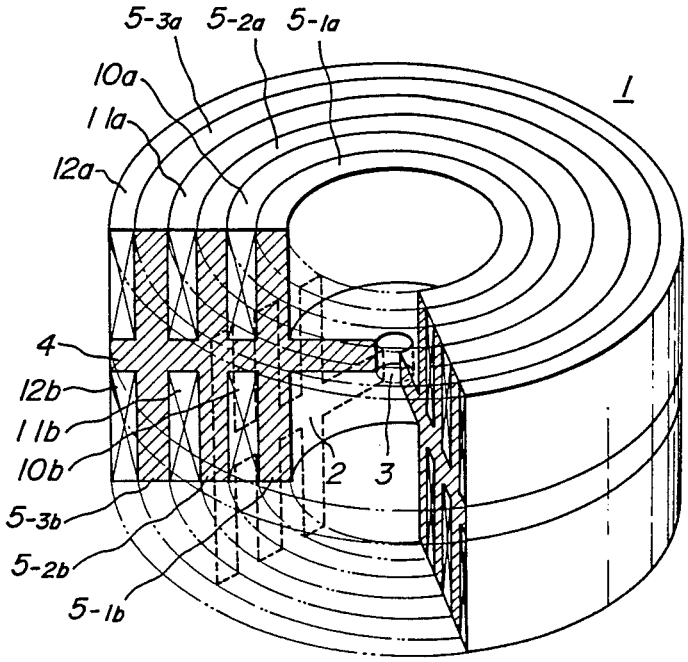
FIG. 5 PRIOR ART
FIG. 5 is a partially cutaway schematic perspective view of a previously disclosed multilayered-eddy-current type strong magnetic field generator.

In this respect that the exciting coils 10 to 12 are driven by three-phase AC power source, it can be exemplified that an eddy-current vector Ic of three-phased eddy-current vectors generated by these exciting coils 10 to 12 is inverted into an opposite-phase vector -Ic as shown in FIG. 4, and hence respective component vectors Ia.c and Ib.c of the eddy currents Ia and Ib can be superposed with each other in the same phase, so as to obtain a balanced state in one phase of the three-phase loading. As a result, a strong magnetic field intensity obtained by the convergence of eddy current can be further increased extremely. This operational effect of extremely strong magnetic field generation obtained by the three-phase excitation can be increased in response to the increased size of the apparatus and hence the effect of the present invention can be further distinguished.

In the above description, the conductor body 1 is formed in a cylindrical shape as a whole. However, the shape of the conductor body 1 is not restricted within the above exemplified, but also can be formed as in a polygon resembled to a cylinder and hence the exciting coil can be appropriately shaped.

Further in the above description, the structure and the operation of the invented apparatus is exemplified in the case that the strong AC magnetic field is continuously generated. However, the invented apparatus can be also arranged such as a strong pulsive magnetic field is continuously generated, for instance, by the excitation effected by only one phase component of AC voltage.

As is apparent from the described above, according to the present invention, it is possible to obtain a remarkable effect such that the eddy current efficiently generated in the conductor plate by the exciting coil driven not only by single phase AC power source but also by multiphase AC power source can be converged around the central hole of the conductor plate and hence the strong AC magnetic field accompanied with reduced leakage can be efficiently generated by the comparatively simple structure.

What is claimed is:

1. A multilayered-eddy-current type strong magnetic field generator characterized by comprising:

a conductor body composed of a cylinder portion, a single circular plate portion connected with an inner wall of said cylinder portion and provided with a hole at a center of said single circular plate portion and a plurality of torus-shaped plate portions individually connected with an outer wall of said cylinder portion apart from each other in an axial direction, a slit extending in a radial direction from a periphery of said conductor body to said central hole being provided throughout all of said portions; and a plurality of exciting coils individually disposed between each of said torus-shaped plate portions of said conductor body along said outer wall of said cylinder portion, wherein eddy currents respectively generated in each of said torus-shaped plate portions of said conductor body under the excitation of said exciting coils in single phase or multiple phases are converged around said central hole of said single circular plate portion of said conductor body through said cylinder portion of said conductor body, so as to generate a concentrated strong magnetic field in said central hole.

* * * * *